US006866525B2

(12) United States Patent
Yonenaka

(10) Patent No.: US 6,866,525 B2
(45) Date of Patent: Mar. 15, 2005

(54) PIM LATCH/EXTRACTOR

(75) Inventor: Tom Yonenaka, Daly City, CA (US)

(73) Assignee: Network Equipment Technologies, Inc., Fremont, CA (US)

( * ) Notice: Subject to any disclaimer, the term of this patent is extended or adjusted under 35 U.S.C. 154(b) by 0 days.

(21) Appl. No.: 10/286,371

(22) Filed: Oct. 31, 2002

(65) Prior Publication Data

US 2004/0087195 A1 May 6, 2004

(51) Int. Cl.[7] ..... H01R 13/62
(52) U.S. Cl. ..... 439/160
(58) Field of Search ..... 439/152, 159, 439/160, 155–158, 798, 752, 759, 732, 725, 153, 372, 64; 361/415, 759, 391, 798, 818, 754

(56) References Cited

U.S. PATENT DOCUMENTS 5,293,303 A * 3/1994 Fletcher et al. ..... 361/798
6,185,106 B1 * 2/2001 Mueller ..... 361/798
6,282,101 B1 * 8/2001 Hanas et al. ..... 361/818

* cited by examiner

*Primary Examiner*—Alex Gilman
(74) *Attorney, Agent, or Firm*—Townsend and Townsend and Crew

(57) ABSTRACT

A latch for latching and extracting a board-type device from a housing, wherein the board-type device includes a face, a bottom edge and a top edge and is mounted within a guide in the housing. The latch includes a handle portion, a pivot portion coupled to the handle, and a securement portion coupled to the pivot portion. The securement portion includes an extraction segment and a latching segment. A pivot couples the latch to the board-like device and the latch is coupled to the board-type device along one of the top edge and bottom edge such that it is oriented perpendicular to the face.

15 Claims, 4 Drawing Sheets

PIM LATCH/EXTRACTOR

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

1. Field of the Invention

The present invention relates to a latch and extractor for flat boards or cards within a housing, and more particularly, to a latch and extractor for plug-in modules mounted within guides in an electronic device.

2. Description of the Prior Art

Many devices include flat boards or cards that are slid into guides within the device. These flat boards are also often latched within the guides to prevent their movement due to various forces such as earthquakes, being bumped into by people, and general movement of the device.

Generally, these devices are electronic in nature and thus, the flat boards or cards are often circuit boards or plug-in modules. Thus, if the plug-in modules lose contact with the appropriate plugs within the device, the device may not function properly, if it even functions at all. Thus, it is important that the plug-in modules are securely mounted or "plugged-in" within the electronic device.

Generally, in order to ensure that the plug-in modules are securely mounted within the electronic device, latches and extractors are located along the leading edge of the plug-in module. These latches and extractors are actuated by rotating them outwardly. Due to their geometry and location, these latches and extractors sacrifice valuable space on the plug-in modules. Additionally, latches and extractors of this type are generally injection molded. Thus, such latches and extractors do not help prevent electromagnetic interference (EMI) with regard to the modules.

SUMMARY OF THE INVENTION

The present invention provides a system for latching and extracting a board-type device from a housing, wherein the board-type device includes a face, a bottom edge and a top edge and is mounted within a guide in the housing. The system includes a latch that includes a handle portion, a pivot portion coupled to the handle, and a securement portion coupled to the pivot portion. The securement portion includes an extraction segment and a latching segment. A pivot couples the latch to the board-like device and the latch is coupled to the board-type device along one of the top edge and bottom edge such that it is oriented perpendicular to the face.

In accordance with one aspect of the present invention, the securement portion includes a hook that engages a slot defined within the guide and an extractor corner.

In accordance with another aspect of the present invention, a spring is included between the latch and the board-type device and biases the latch in a latching position.

In accordance with a further aspect of the present invention, the handle portion includes an extension perpendicular to the latch.

In accordance with yet another aspect of the present invention, the system includes two latches, with a first latch being located at the top edge of the board-like device and a second latch being located at the bottom edge.

The present invention also provides methods for manipulating board-like devices within a housing and for removing board-like devices from a housing. The methods include placing at least one board-like device within a guide within the housing and moving at least one latch in a first direction perpendicular to a face of the board-like device until it engages a slot defined within the guide. The methods also include moving at least one latch in a second direction perpendicular to the face, engaging a portion of the at least one latch with a corresponding guide, and then removing at least one board-like device from the corresponding guide.

The systems and methods disclosed herein are especially useful with plug-in modules for electronic devices such as, for example, computers, servers, etc. Because the latch is perpendicular to the face of the plug-in modules and is located along the top and bottom edges of the modules, board or module space is not sacrificed. Additionally, the latches in accordance with the present invention are preferably made of a conductive material such as metal and therefore, help prevent electromagnetic interference with regard to the operation of the modules when the latches are latched to the guides.

The preferred exemplary embodiments of this invention will now be discussed in detail. These embodiments depict the novel and nonobvious latching/extracting systems and methods of this invention shown in the accompanying drawings, which are included for illustrative purposes only, with like numerals indicating like elements.

DETAILED DESCRIPTION OF THE INVENTION

Figure 1:
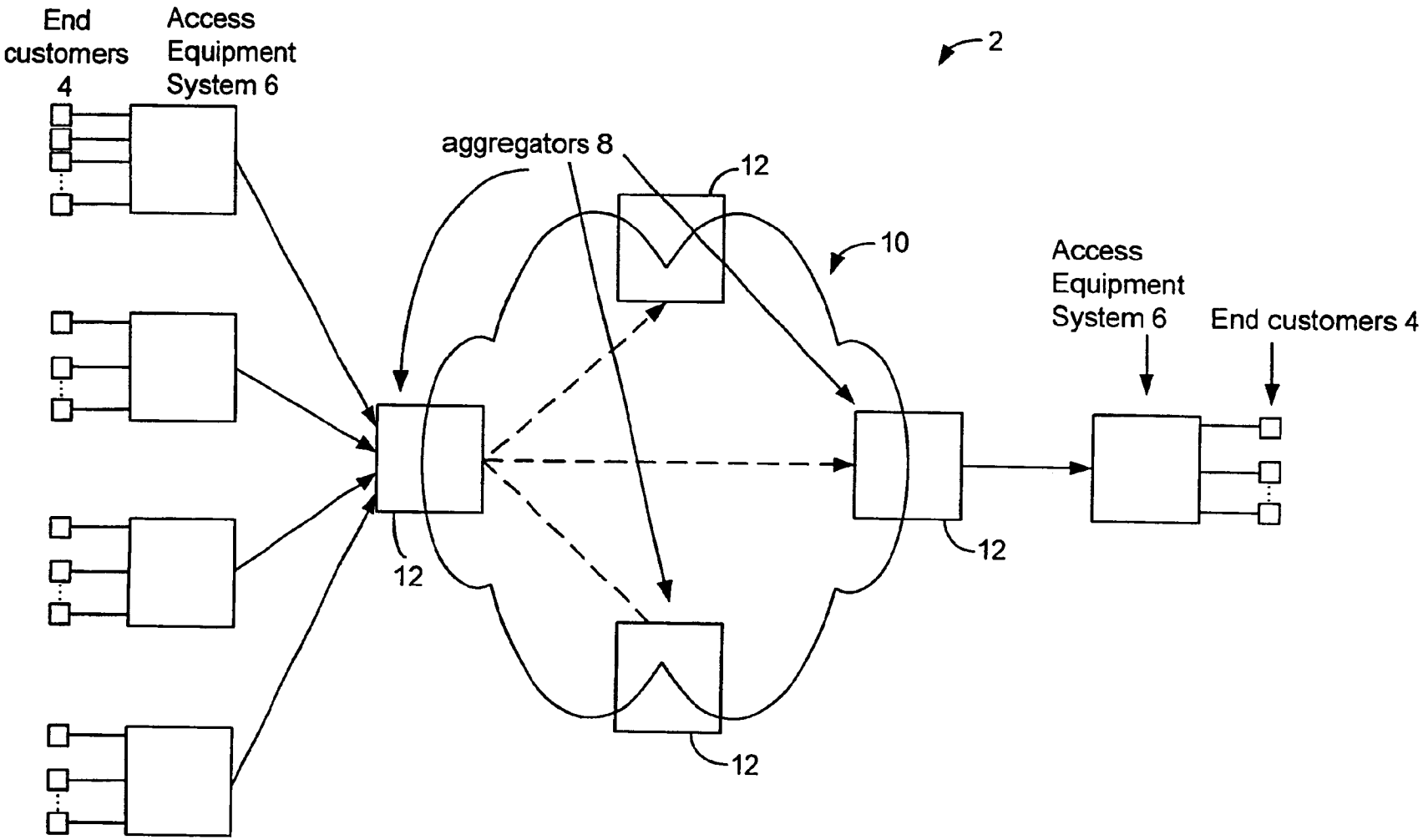
FIG. 1 depicts a simplified block diagram of a telecommunications system.

FIG. 1 depicts a simplified block diagram of a telecommunications system 2 according to one embodiment of the present invention. Telecommunications system 2 includes end customer devices 4, access equipment 6, aggregators 8, and a network 10.

End customer devices 4 are computing devices, such as personal computers (PCs), workstations, personal digital assistants (PDAs), cellular phones, personal PCs, and the like, that communicate data. The data are transmitted to access equipment system 6 through communication lines.

Access equipment systems 6 aggregate and multiplex the data received from end customer devices 4. Examples of access equipment systems 6 include digital subscriber line access multiplexer (DSLAM), multiplexers, etc. Data received at access equipment systems 6 are then sent to aggregators 8. Data from a single access equipment system 6 are typically sent in a specific data format and a specific data rate. For example, the data formats include SONET/SDH (OC3, OC12, OC48, etc.), DS3/E3, Ethernet, Gigabit Ethernet, etc. Data in these formats are also transferred at various data rates, where a fixed data rate is associated with a format.

Aggregator 8 receives the data from access equipment systems 6 in the different formats. Aggregator 8 processes the data in the different formats and may send the data to one or more other aggregators 8. Data may be sent in different formats than the received data format. Data are then sent to access equipment system 6 and to another end customer 4 through network 10. Network 10 may be any network, such as the Internet.

A plurality of network communication modules 12 are provided within network 10 to receive data from a variety of ports. Network communications modules 12 generally are in the form of computer-type devices that include a housing with a plurality of electronic circuit boards or cards. Many of these are in the form of plug-in modules that are slid into guides within the housing. The plug-in modules are often latched into place to secure them within the guides.

Figure 2:
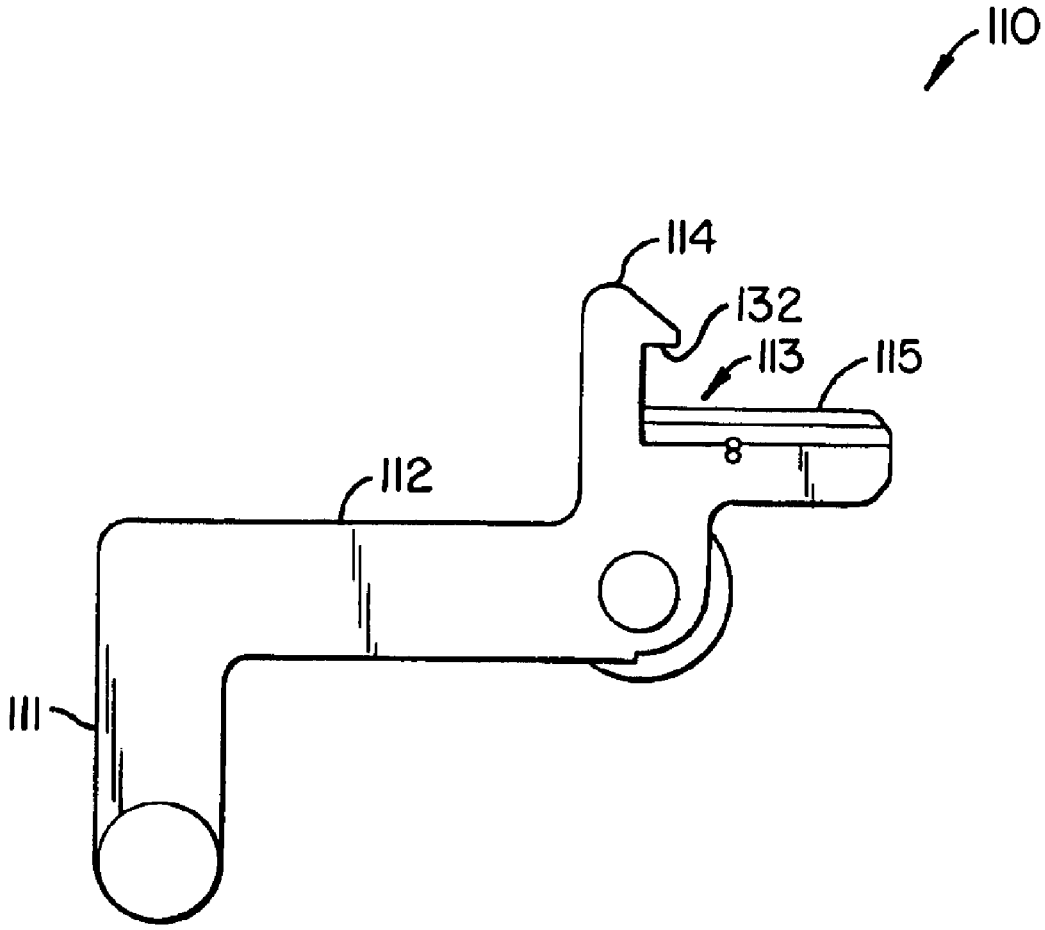
FIG. 2 is a plan view of latch/extractor in accordance with the present invention.

FIG. 2 illustrates a plug-in module latch/extractor 110 in accordance with the present invention. The latch includes a handle portion 111 coupled to a pivot portion 112. A securement portion 113 is coupled to the pivot portion. The securement portion includes an extraction segment 114 and a latching segment 115. As can be seen in FIG. 2, the latching segment is preferably formed similar to a hook. A handle or extension 116 is preferably coupled to the handle portion, preferably with a small screw, pin, rivet, etc. 117.

Figure 3:
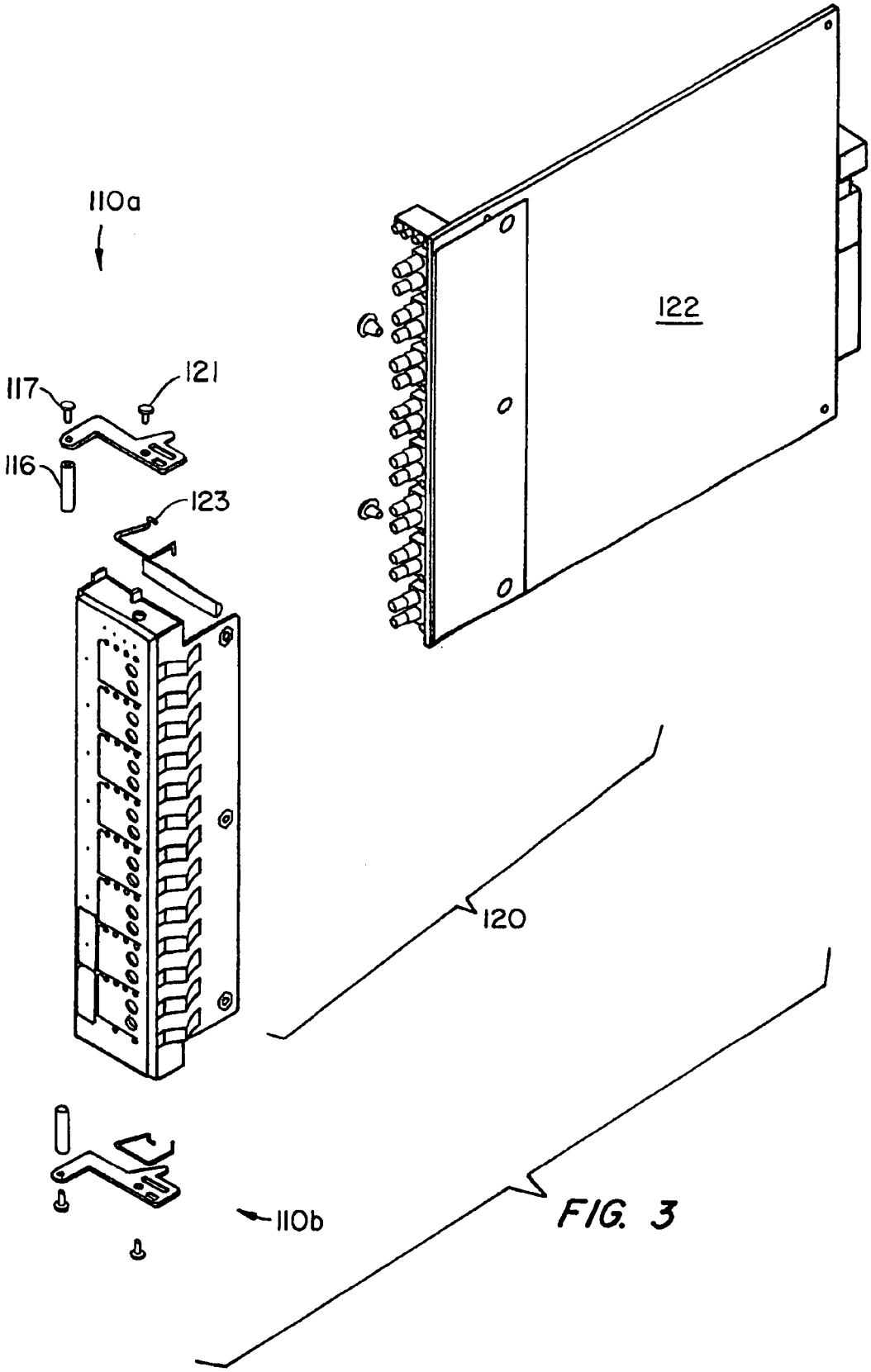
FIG. 3 is an exploded view of a plug-in module and latches/extractors in accordance with the present invention.

As can be seen in FIG. 3, the latch is coupled to a plug-in module 120 with a pivot pin 121 in the form of a screw, pin, rivet, etc. The latch is coupled to the module at the top edge of the module such that it is oriented perpendicular to the main, flat portion or face 122 of the module. A spring 123 is preferably included between the plug-in module and the latch. As can be seen in FIG. 3, the spring is basically formed from wire. The spring biases the latch in a closed or latched position.

As can be further seen in FIG. 3, preferably two latches 110*a*, 110*b* are coupled to each plug-in module. This provides greater securement for the plug-in module in addition to easier extraction of the plug-in module. The latches are preferably coupled to the plug-in module in the same manner as described above.

Figure 4:
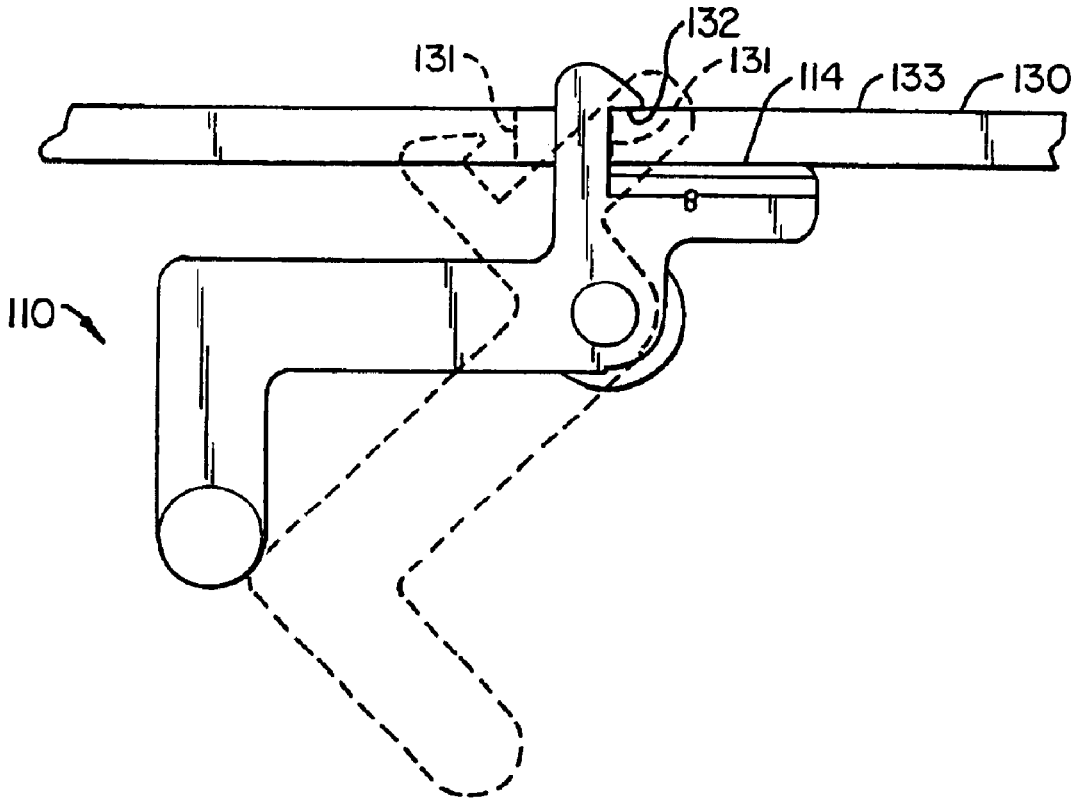
FIG. 4 is plan view of a latch/extractor in accordance with the present invention illustrating use thereof.

FIG. 4 illustrates the latch in use with a guide 130 for the plug-in module. The plug-in module is placed within the guide as is generally known in the art. The latch is moved to an unlatched or open position as indicated in phantom. As the module is slid further into the guide, the latch is moved to the closed or latched position such that the latching segment is inserted into a slot 131 defined within the guide. Once the plug in module is fully inserted within the guide and the latching segment is fully within the slot, lip 132 of the latching segment abuts an edge 133 of the guide from within the slot. Thus, the plug-in module cannot be removed from the guide due to the interference of the latching segment with the edge of the guide.

When the latch is in the fully closed and latched position, as indicated in solid lines in FIG. 4, extraction segment 114 is adjacent the guide. In order to remove the plug-in module from the guide, the latch is moved to the open position, which is indicated in phantom. This moves the latching segment away from guide edge 133 and also pushes the extraction segment against the edge of the guide. This helps push the plug-in module out of the guide, thus aiding in removal of the plug-in module from the guide.

Preferably, the latch is cut or stamped from sheet metal and is therefore conductive. Accordingly, when the latch is used to secure the plug-in module within the guide, the latch helps ground the plug-in module and block electromagnetic noise due to its contact with the guide.

Thus, the present invention provides a latch/extractor for use with flat board-type devices such as circuit boards and cards in the form of plug-in modules. The latch does not interfere with components and cables on the face of the board or protruding from the side edge of the board since the latch is coupled to the plug in module on the top and bottom edges of the module and are thus, perpendicular to the face of the module.

The above description is illustrative but not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

What is claimed is:

1. A system for latching and extracting a board-type device from a housing, wherein the board-type device includes a face, a top edge and a bottom edge and is mounted within a guide within the housing, the system comprising:

a substantially flat latch comprising a handle portion, a pivot portion coupled to the handle, and a securement portion coupled to the pivot portion, wherein the securement portion comprises an extraction segment and a latching segment; and a pivot coupling the latch to the board-like device;

wherein the latch is coupled to the board-like device along one of the top edge and the bottom edge such that it is oriented perpendicular to the face and perpendicular to a mating direction for the board-type device.

2. A system in accordance with claim 1 wherein the securement portion comprises a hook that engages a slot defined within the guide and an extractor corner.

3. A system in accordance with claim 1 further comprising a spring between the latch and the board-type device.

4. A system in accordance with claim 1 wherein the handle portion comprises an extension parallel to the face.

5. A system in accordance with claim 1 comprising two latches, a first latch being located at the top edge of the board-like device and a second latch being located the bottom edge.

6. A system in accordance with claim 1 wherein the latch comprises a conductive material.

7. An electronic device comprising a plurality of plug-in modules within a plurality of corresponding guides, each module including a face, a top edge and a bottom edge comprising:

at least one substantially flat latch/extractor comprising a handle portion, a pivot portion coupled to the handle, and a securement portion coupled to the pivot portion, wherein the securement portion comprises an extraction segment and a latching segment; and at least one pivot coupling the at least one latch/extractor to the module, the at least one pivot being coupled to its respective module at the top edge;

wherein the at least one latch/extractor is coupled to the plug-in module such that it is oriented perpendicular to the face and perpendicular to a mating direction for the plug-in module.

8. An electronic device in accordance with claim 7 wherein the securement portion comprises a hook that engages a slot defined within the guide and an extractor corner.

9. An electronic device in accordance with claim 7 further comprising a spring between each latch/extractor and its respective module.

10. An electronic device in accordance with claim 7 wherein the handle portion comprises an extension parallel to the face.

11. An electronic device in accordance with claim 7 wherein each module comprises two latch/extractors, a first latch/extractor being located at a first end of its respective module and a second latch/extractor being located at a second end opposite the first end.

12. An electronic device in accordance with claim 7 wherein the latch/extractor comprises a conductive material.

13. A method of manipulating plug-in modules within an electronic device, the method comprising:

providing a plurality of plug-in modules within a plurality of corresponding guides, each module including a face and comprising:

at least one substantially flat latch/extractor comprising a handle portion, a pivot portion coupled to the handle, and a securement portion coupled to the pivot portion, wherein the securement portion comprises an extraction segment and a latching segment; and at least one pivot coupling the at least one latch/extractor to the module, the at least one pivot being coupled to its respective module at a top edge of the module;

wherein the at least one latch/extractor is coupled to the module such that it is oriented perpendicular to the face and perpendicular to a mating direction for the plug-in module; and moving at least one latch/extractor in a first direction perpendicular to the face until it engages a slot defined within the guide.

14. A method in accordance with claim 13 further comprising:

moving at least one latch/extractor in a second direction perpendicular to the major axis;

engaging a corner of the at least one latch/extractor with a corresponding guide; and removing the corresponding module from the corresponding guide.

15. A method of removing plug-in modules from an electronic device, the method comprising:

providing a plurality of plug-in modules within a plurality of corresponding guides, each module including a face and comprising:

at least one substantially flat latch/extractor comprising a handle portion, a pivot portion coupled to the handle, and a securement portion coupled to the pivot portion, wherein the securement portion comprises an extraction segment and a latching segment; and at least one pivot coupling the at least one latch/extractor to the module, the at least one pivot being coupled to its respective module at a top edge;

wherein the at least one latch/extractor is coupled to the module such that it is oriented perpendicular to the face and perpendicular to a mating direction for the plug-in module;

moving at least one latch/extractor in a direction perpendicular to the face;

engaging a corner of the at least one latch/extractor with a corresponding guide; and removing the corresponding module from the corresponding guide.

* * * * *